US006226838B1

(12) United States Patent
Raasch

(10) Patent No.: US 6,226,838 B1
(45) Date of Patent: May 8, 2001

(54) DEVICE FOR OPENING SLIVERS

(75) Inventor: Hans Raasch, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/427,363

(22) Filed: Oct. 26, 1999

(30) Foreign Application Priority Data

Nov. 3, 1998 (DE) ..... 198 50 518

(51) Int. Cl.[7] ..... D01G 19/00

(52) U.S. Cl. ..... 19/115 R; 19/215; 19/233

(58) Field of Search ..... 19/98, 99, 100, 19/112, 114, 115 A, 115 B, 115 R, 122, 123, 124 R, 215, 216, 217, 218, 219, 229, 233, 234, 235, 129 R, 65 R, 105; 57/412

(56) References Cited

U.S. PATENT DOCUMENTS

| | | | | |
|---|---|---|---|---|
| 787,139 | * | 4/1905 | Wenning et al. | 19/218 |
| 979,389 | * | 12/1910 | Evans et al. | 19/115 B |
| 1,663,170 | * | 3/1928 | Nasmith | 19/218 |
| 3,161,921 | * | 12/1964 | Hattori | 19/234 |
| 3,971,104 | * | 7/1976 | Turpie et al. | 19/115 R |
| 4,398,319 | * | 8/1983 | Viaggi | 19/129 R |
| 4,459,801 | * | 7/1984 | Stahlecker et al. | 57/412 |
| 4,554,709 | * | 11/1985 | Bianchi | 19/218 |
| 5,003,793 | * | 4/1991 | Leins et al. | 19/114 |
| 5,333,358 | * | 8/1994 | Leifeld | 19/105 |
| 5,367,747 | * | 11/1994 | Shofner et al. | 19/65 R |
| 5,426,824 | * | 6/1995 | Gloor et al. | 19/115 A |
| 5,446,945 | * | 9/1995 | Hachenberger | 19/99 |
| 5,491,876 | * | 2/1996 | Shofner et al. | 19/129 R |
| 5,546,635 | * | 8/1996 | Leifeld | 19/65 R |
| 5,655,262 | * | 8/1997 | Sterin et al. | 19/114 |
| 5,778,493 | * | 7/1998 | Moretti et al. | 19/115 R |

FOREIGN PATENT DOCUMENTS

| | | |
|---|---|---|
| 24 40 224 | 3/1978 | (DE) . |
| 366 110 | 8/1978 | (DE) . |
| 31 27 415 A1 | 2/1983 | (DE) . |
| 41 01 680 A1 | 7/1992 | (DE) . |
| 43 09 947 A1 | 9/1994 | (DE) . |
| 195 26 845 A1 | 1/1997 | (DE) . |

* cited by examiner

*Primary Examiner*—John J. Calvert
*Assistant Examiner*—Gary L. Welch
(74) *Attorney, Agent, or Firm*—Kennedy Covington Lobdell & Hickman, L.L.P.

(57) ABSTRACT

A device for opening slivers (4) for feeding an OE spinning device (3), comprising a sliver feed device defining a sliver clamping position (7), a rotating opening roller (8) having a circumference with spirally extending combing elements (9, 24) for engaging at the clamping position (7) into a sliver being fed by the sliver feed device. In order to improve the opening of the sliver, a support roller (13, 28, 29) also having spirally extending combing elements (14, 24, 25, 26) is arranged in the direction of fiber feeding after the clamping position (7) with its combing elements (14, 24, 25, 26) extending into the intermediate spaces between the spirally extending combing elements (9, 24) of the opening roller (8) and rotates counter to the opening roller (8) for combing sliver therewith in a common effective range (11).

14 Claims, 3 Drawing Sheets

DEVICE FOR OPENING SLIVERS

BACKGROUND OF THE INVENTION

The present invention relates to a device for opening slivers and, more particularly, to a device for opening slivers for feeding an OE spinning device comprising a sliver feed device defining a sliver clamping position and a rotating opening roller having a circumference with spirally extending combing elements for engaging at the clamping position into a sliver being fed by the sliver feed device.

For open-end (OE) spinning, a sliver is separated into its individual fibers by means of an opening roller carrying combing elements, e.g. sawteeth or needles, on its circumference. The sliver is uniformly fed to the opening roller by a feeding device. To this end, a known feeding device comprises a grooved, serrated or fluted roller and a feed table or a feed trough, both of which cooperate to form a clamping position. The sliver passes on the deflection edge of the feed table into the effective range of the combing elements on the circumference of the revolving opening roller. The sliver is deflected thereby and combed out as so-called fiber tufts. The opening roller is usually driven at a circumferential speed of 20 to 30 m/sec. In order to avoid an uneven opening of the sliver and an increased loosening out of fiber tufts which were not opened or opened only incompletely, high circumferential speeds of the opening roller are selected.

The combing elements are arranged on the circumference of the opening roller in such a manner that their tips, which ideally are equally spaced relative to the axis of rotation of the opening roller, are located on an imaginary spiral or helical curve, comparable to a single or multiple thread. The combing elements and their forward surfaces are usually inclined at an angle of 15° to 20° in the direction of travel of the opening roller to support the drawing in of the fibers into the channels formed by the spiral course of the tips between the combing elements. However, such a so-called positive breast angle of the combing elements makes it difficult to loosen the fibers from the opening roller for further transport in the air current. In order to gain support during the loosening of the fibers from the combing elements of the opening roller, the speed of the transport air is adjusted higher than the circumferential speed of the opening roller. The fibers are transported to a twist-imparting device such as a spinning rotor or friction rollers, where they are collected into a desired yarn thickness, drawn off and twisted.

An open-end spinning device with two friction rollers and designed as a friction spinning device is described, e.g., in German Patent Publication DE 195 26 845 A1.

German Patent Publication DE 24 40 224 B2 teaches blowing air radially to the opening roller in the area of the fiber tufts in order to press the fiber tuft onto the combing elements of the opening roller. This is intended to prevent the freely suspended fiber tuft from moving away from the fittings and the opening from becoming worse. However, it is very difficult to bring about a uniform dosing of the supply of air to all spinning locations. In addition, there is the disadvantage that the current of pressurized air entrains short fibers and that the additional, constant consumption of compressed air significantly increases the operating costs.

German Patent Publication DE 31 27 415 A1 discloses a sliver feeding and opening device which is intended to hold the sliver in the area of the fittings of the opening roller by using stationary support elements designed as a cogged strip and to prevent a shifting of the fiber tuft in the axial direction of the opening roller. The teeth of a support element can engage thereby into the fittings channels present between the fitting elements. The use of the support element as a combing element requires parallel rows of teeth on the circumference of the opening roller, like those shown in FIG. 8 of German Patent Publication DE 31 27 415 A1. However, parallel rows of teeth are not suitable for an effective combing out of the sliver. For this reason the device has not been accepted in the last two decades.

SUMMARY OF THE INVENTION

It is accordingly an object of the present invention to improve the known devices for opening slivers for the feeding of an OE spinning device in order to overcome their disadvantages discussed above.

This objective is achieved by a device for opening slivers for feeding an OE spinning device which comprises a sliver feed device defining a sliver clamping position, a rotating opening roller having a circumference with spirally extending combing elements for engaging at the clamping position into a sliver being fed by the sliver feed device, and a support roller rotating in the opposite direction from the opening roller and also comprising spirally extending combing elements. According to the present invention, the respective combing elements of the opening roller and the support roller mesh with one another in a common effective range adjacent the clamping position downstream of the direction of sliver feeding by the sliver feed device, with the combing elements of the support roller extending into intermediate spaces between the spirals of the combing elements of the opening roller. Preferably, the opening roller and the support roller are driven at a translation ratio of their respective speeds comparable to a ratio between a rise of the spiral of the combing elements of the opening roller and a rise of the spiral of the support roller.

This design of the device in accordance of the present invention results in an especially intensive action and interaction of the combing elements of the opening roller and of the support roller on the fiber material. On the one hand, the fiber material is better drawn into the effective range of the combing elements as well as better pressed into the channels between the combing elements and exposed more heavily to the action of the combing elements. On the other hand, however, the removal of the fibers out of the opening roller is supported by the friction of the additional combing elements. A turning aside of the fiber tuft in front of the combing elements is prevented and the number of combing elements engaging simultaneously into the fiber material and their action on the fiber material is increased in an advantageous manner. The opening of the fiber material is significantly improved.

The arrangement of the combing elements on the opening roller in the form of a single or multiple thread likewise results in a support during the loosening of the fibers from the opening roller, by means of the axial thrust which the turns of the threads produce on the fibers. A reliable loosening of the fibers from the opening roller is thereby achieved. A reliable maintenance of the required angular position of the support roller relative to the opening roller is assured without mutual contact. One simple, functionally reliable embodiment would be an apparatus that has both a rotating opening roller with helically extending combing elements on its circumference and a reinforcing roller also with helically extending combing elements which rotates contrary to the opening roller and meshes therewith in a common operative region, and wherein the translation ratio between the rotary speeds of the opening roller and the reinforcing roller, and the ratio of the rise i.e. the pitch height, of the helix formed by the combing elements disposed on the opening roller to the rise (pitch height) of the reinforcing roller, are equal. In particular, a contact is avoided with simultaneous optimization of the action of the combing elements if the engagement of the combing elements of the support roller takes place into the middle of the channel-shaped intermediate space between the spirals of the combing elements of the opening roller. Furthermore, the opening rollers manufactured economically on a large scale can be used in a normal design.

The combing elements are preferably designed in such a manner that they have a breast angle $\alpha$ in the range of +5° to −10°. This design makes it significantly easier to loosen the fibers out of the opening roller and makes it possible to allow the air current used to support the loosening of the fibers out of the opening roller to flow at a low speed. The pressure difference required to produce the air current can be lowered to a much lower value than is customary. The negative pressure of a vacuum source serving to produce the air current loaded with the fibers loosened from the opening roller is advantageously below 10 mbar, especially 3 to 5 mbar. A negative pressure for generating the current of transport air, which pressure is clearly reduced in comparison to a negative pressure of 20 to 25 mbar in the case of customary opening devices, results in significant savings of operating costs given the large number of spinning positions in a spinning machine. These savings can be achieved both in friction spinning machines and also in rotor spinning machines.

The circumferential speed of the opening roller is preferably less than 15 meters per second (m/s), preferably 4 to 10 m/s. This makes possible a particularly gentle opening process and reduces fiber damage and wear on the combing elements. The production of fine dust can also be reduced in this manner. In particular, however, this causes the fibers, all of which are not accelerated in any case on the short path between the fiber tuft and the opening in the roller cover leading into the fiber guide conduit up to the circumferential speed of the opening roller, to separate at a distinctly lesser speed than is customary from the opening roller. The reduced circumferential speed of the opening roller, the residence time of the fibers on the circumference of the opening roller and, in addition, the cooperation with a reduced speed of the air current between the opening roller and the OE spinning device result in a desired, low speed of the fibers when they strike in the spinning nip of a friction spinning device. There, the fibers strike a forming yam which is normally moved and drawn off at a speed of only 3 to 5 m/sec. During the striking the significant compression which otherwise occurs is avoided in the design of the device in accordance with the present invention and the effect resulting therefrom that the fibers are not present in drawn form in the yarn bundle is prevented. This has an advantageous effect on the yarn parameters, e.g., the strength.

The support roller is preferably connected via a geared drive to the opening roller and the translation ratio between the opening roller and the support roller is 1:2. As a result of the positive construction of the drive, the translation ratio is maintained constant and reliable in a simple manner and a contactless engagement of the combing elements assured therewith. The gears associated with the rollers can receive the same diameter as the particular roller. In addition, such a design simplifies the mounting and dismounting of the two rollers.

In a preferred embodiment at least a partial area of the surface of the combing elements is designed as a roughened surface. The effect of the combing elements can be reinforced with a roughened surface.

The spiral formed by the arrangement of the combing elements is advantageously interrupted in its course around the circumference of the roller by sections free of combing elements. This prevents a lateral exiting of fibers out of the combing area produced by excessive axial transporting action as can occur in the case of a slight interval between successive combing elements or in the case of a close spacing of needles.

The preferable design of the combing elements of the support roller as sections of a V-shaped angular sharpened thread can be manufactured in an especially simple and economical manner. The V-shaped thread is in the shape of an inverted 'V' with the apex of the 'V' extending outwardly to engage the sliver. After the positioning of a thread on the roller surface the production of the sections can take place by milling or grinding. The design with thread spirals present only in sections on the circumference of the support roller supports a desired axial traveling of individual fibers on the circumference of the opening roller from one combing-element channel to the adjacent combing-element channel, which axial travel serves to make the opening process more uniform, without the previously described excessive axial transport action with its disadvantageous consequences occurring.

In a further advantageous embodiment of the invention, the support roller is mounted in a holder which carries the sliver feed device at the same time. Pivoting the holder together with the support roller by means of a handle can cause the combing elements of the opening roller and of the support roller to come out of engagement and both rollers can be dismounted by drawing them out axially. The mounting and dismounting of the opening roller and of the support roller is simplified and rendered easier in this manner. The arrangement of the sliver feed device on the holder and the mounting of the support roller in this holder make possible an especially compact construction and a ready accessibility to the components of the opening device.

The opening roller and the support roller advantageously comprise markings for positioning. The markings can be readily produced with little expense, e.g., by applying paint or by scratching or stamping, and allow a rapid and precise reproduction of the required angular position and of the axial position as a mounting aid when the two rollers are remounted.

Further details, features and advantages of the present invention will be understood from the following disclosure of exemplary embodiments with reference to the accompanying drawings.

DETAILED DESCRIPTION OF THE PREFERRED EMBODIMENTS

Figure 1:
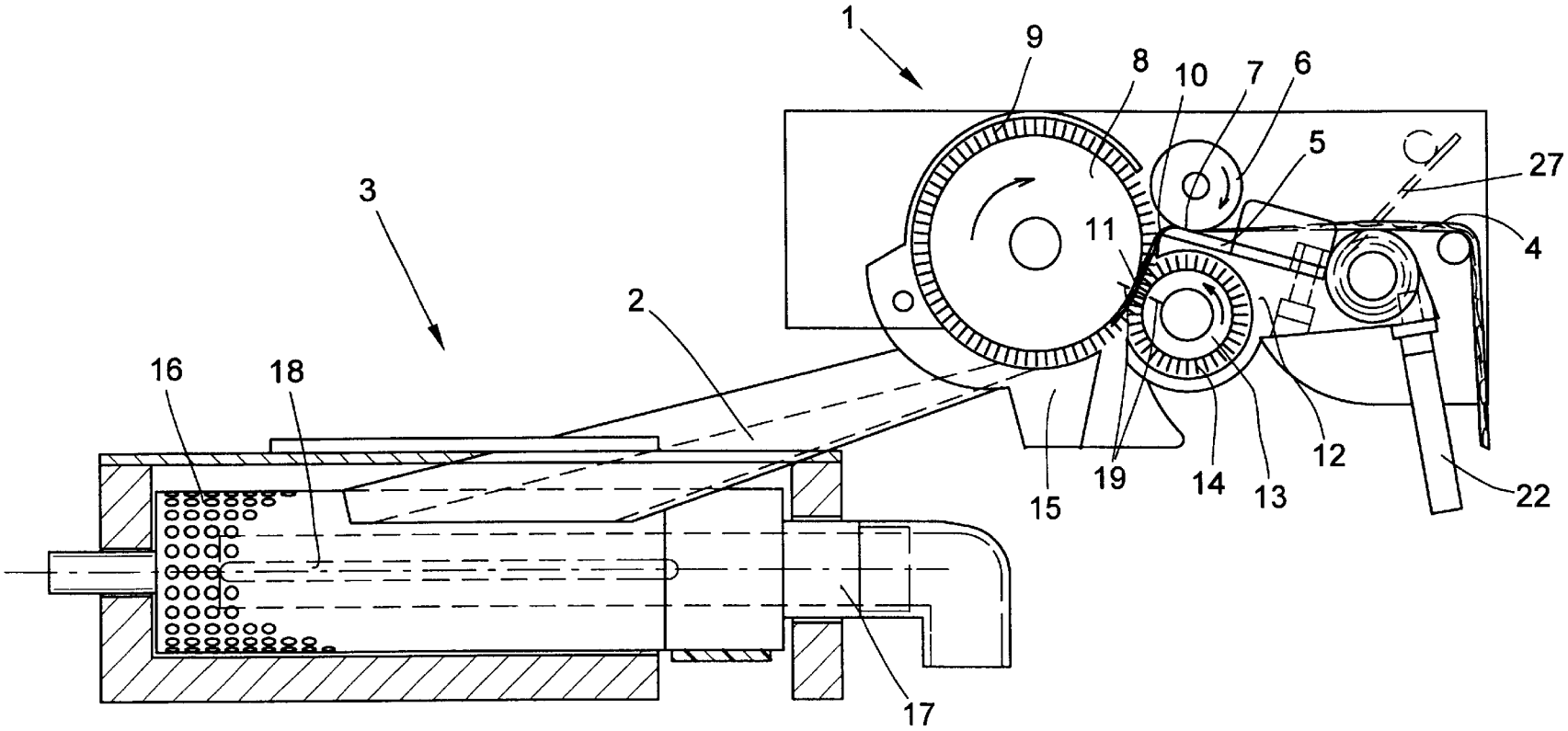
FIG. 1 is a front view of an opening device in accordance with a preferred embodiment of the present invention shown in conjunction with a friction spinning device shown in section.

FIG. 1 shows an opening device I which is connected via fiber guide conduit 2 to OE spinning device 3. The fiber material is fed in the form of sliver 4 over feed table 5 by means of feed roller 6 to opening roller 8. Spring 27 presses feed table 5 against feed roller 6. This forms clamping position 7 through which sliver 4 must pass. After passing through clamping position 7, sliver 4 passes into the effective range of opening roller 8 and is deflected on the front edge of feed table 5. Combing elements 9 of opening roller 8 comb the fiber material extending as fiber tuft 10 into the effective range of opening roller 8 and loosen fibers out of the fiber bundle. Feed table 5 is arranged on holder 12 in which support roller 13 is mounted underneath feed table 5. Support roller 13 engages with its combing elements 14 into the effective range of combing elements 9 of opening roller 8 and creates in this manner a common effective range 11 with opening roller 8. Combing elements 9 of opening roller 8 and combing elements 14 of support roller 13 are designed as needles arranged so that they stand vertically on the roller circumference. The needles have a forward so-called breast angle of 0° in this position. However, they can also be designed as teeth, especially as the teeth of an all-steel fitting.

Whereas the rotation of opening roller 8 takes place clockwise in the view of FIG. 1, support roller 13 rotates in the opposite direction. The direction of rotation of the rollers is made clear by directional arrows. The position of opening roller 8 and of support roller 13 is adjusted so that the tips of combing elements 14 of support roller 13 extend while passing through the effective range 11 between the opening and support rollers 8, 13 into the free spaces between combing elements 9 of opening roller 8 and, conversely, combing elements 9 of opening roller extend in effective range 11 into the free spaces between combing elements 14 of support roller 13. As a result, all fibers of fiber tuft 10 pass through the effective range 11 of combing elements 9, 14 and are processed to a large extent equally strongly by combing elements 9, 14.

Beyond the effective range 11 the fibers combed out of fiber tuft 10 are separated with the support of an air current from opening roller 8 through an opening in roller cover 15 which is located in the vicinity of effective area 11 and are transported through fiber guide conduit 2 into the spinning nip formed by two sieve drums 16 of OE spinning device 3, designed as a friction spinning device. The interval between effective range 11 and the opening in roller cover 15 is kept small so that most of the fibers are not accelerated in this short path to the circumferential speed of opening roller 8.

The two sieve drums 16 of OE spinning device 3 are supported on fixed suction device 17, which is fed from a negative-pressure source, not shown for reasons of simplicity. A suction slot 18 is directed each time toward the spinning nip. The air flowing in through suction slots 18 is conducted to the spinning nip through the opening in roller cover 15 and through fiber guide conduit 2. The developing yarn strand rotates due to the friction on sieve drums 16 and produces a yarn. The yam is drawn off by a drawing-off device (not shown) and wound onto a bobbin.

Figure 2:
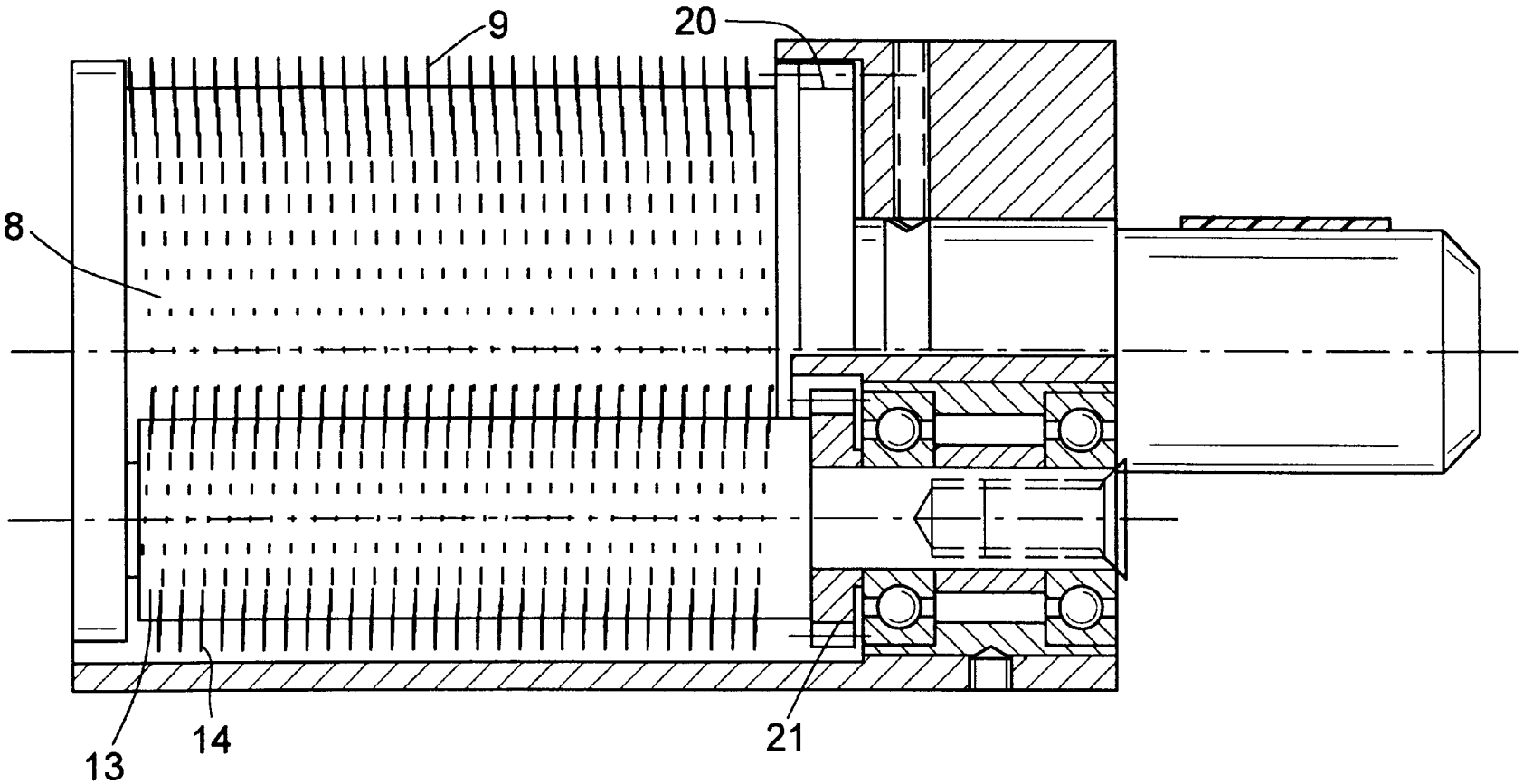
FIG. 2 shows the opening device of FIG. 1 in a lateral view in partial section.

In the lateral view shown in FIG. 2, it can be recognized that combing elements 9, 14 of opening and support rollers 8,13 are arranged so that they extend in a spiral. The direction of rise, i.e., the incline or pitch, of the spiral of opening roller 8 is opposite the direction of rise of support roller 13, corresponding to the directions of rotation of opening roller 8 and support roller 13.

As previously described, opening roller 8 and support roller 13 are arranged relative to one another such that spirally arranged combing elements 14 of support roller 13 extend through effective range 11 into the middle of the channel-shaped intermediate spaces between adjacent spirals of the similarly spirally arranged combing elements 9 of opening roller 8. Opening roller 8 and support roller 13 have markings 19 on their front which are set in alignment, as shown in FIG. 1, and thus permit a rapid reproduction of the required angular positions. The drive of support roller 13 takes place by a gear drive with gear 20 rotating with opening roller 8 and with gear 21 rotating with support roller 13. Holder 12 can be pivoted counterclockwise with lever 22, shown in FIG. 1, so that combing elements 9, 14 and gears 20, 21 come out of engagement and opening roller 8 and support roller 13 can be dismounted by being drawn out axially.

Figure 3:
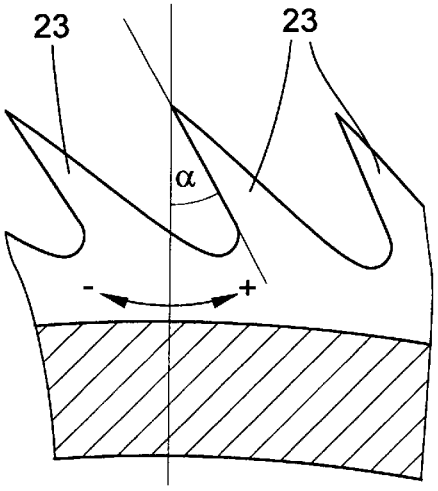
FIGS. 3 to 6 show different embodiments of the combing elements.

FIG. 3 shows teeth 23 of an all-steel fitting on a traditional opening roller, which teeth function as combing elements. Teeth 23 are designed with a positive breast angle $\alpha$, as is normally used for opening rollers in order to support the drawing in of the fibers between the combing elements of the opening roller, but which angle makes it quite difficult to loosen the fibers out of the opening roller.

Figure 4:
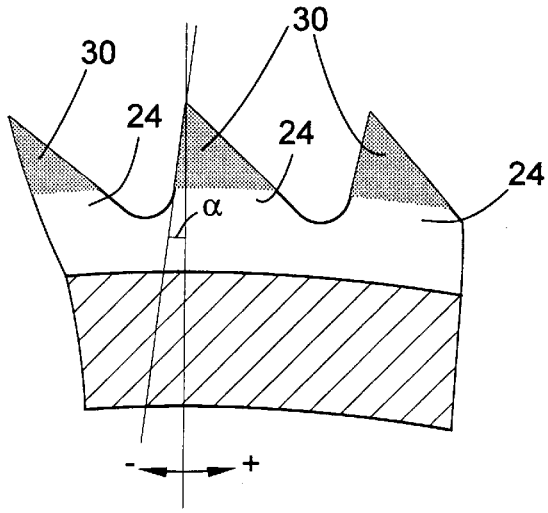

FIG. 4 shows teeth 24 of an all-steel fitting with negative breast angle $\alpha$, which teeth can function as combing elements 9, 14, 24 in accordance with the invention. The negative breast angle $\alpha$ of teeth 24 significantly facilitates the separating of fibers out of opening roller 8. The arrangement and function of support roller 13 assures a sufficient drawing in of the fibers of fiber tuft 10 into the channels between combing elements 9 thereby. Teeth 24 have a roughened surface on their two sides in partial area 30. This roughened surface can be produced, e.g., by jet treatment or also by coating with diamond grains and heightens the loosening and entraining action of combing elements 9 on the fibrous material by virtue of its roughness.

Figure 5:
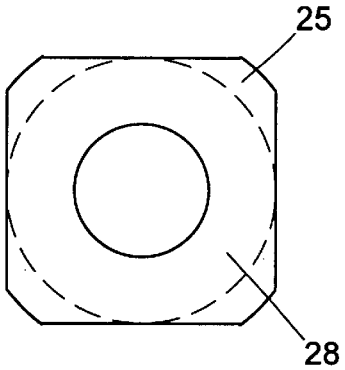
Figure 6:
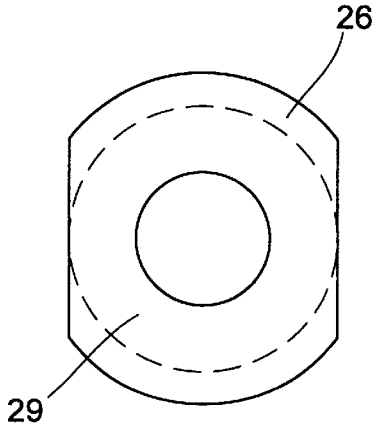

The embodiments of support roller 28, 29 shown in FIGS. 5, 6 comprise combing elements 25, 26 produced, e.g., by milling work on a roller with a continuous V-shaped spiral thread. The embodiment of support roller 28 has four combing elements 25 per turn and the embodiment of support roller 25 has two combing elements 26 per turn. The flattened worked surfaces produced by milling interrupt the spirals of the particular V-thread and produce the forms acting as combing elements 25, 26.

Although a friction spinning device is shown as an exemplary embodiment of the invention in FIG. 1, it will be understood that the subject matter of the invention can also be used with advantage in rotor spinning devices like those known, e.g., from German Patent Publication DE 43 09 947 A1. The invention is not limited to the embodiments and exemplary applications presented.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof

What is claimed is:

1. A device for opening slivers (4) for feeding an OE spinning device (3), comprising a sliver feed device defining a sliver clamping position (7) located between a feed roller (6) and a feed table (5), a rotating opening roller (8) having a circumference with spirally arranged combing elements (9, 24) extensibly fixed thereon for engaging at the clamping position (7) into an end of a sliver being fed by the sliver feed device, the spirally arranged combing elements (9, 24) forming spirally arranged intermediate spaces on the circumference of the opening roller (8), and a support roller (13, 28, 29) rotating in the opposite direction from the opening roller (8) and comprising extensibly fixed spirally arranged combing elements (14, 24, 25, 26), the respective combing elements of the opening roller (8) and the support roller (13,28,29) meshing with one another in a common effective range (11) adjacent the clamping position (7) downstream of the direction of sliver feeding by the sliver feed device, the combing elements of the support roller (13, 28, 29) extending into the spirally arranged intermediate spaces between the spirals of the combing elements (9, 24) of the opening roller (8), the opening roller (8) and the support roller (13, 28, 29) being driven at a translation ratio of their respective speeds comparable to a ratio between a rise of the spiral of the combing elements (9, 24) of the opening roller (8) and a rise of the spiral of the support roller (13, 28, 29).

2. The device according to claim 1, characterized in that the intermediate spaces between the spirals of the combing elements (9, 24) of the opening roller (8) define channels and the combing elements (14, 24, 25, 26) of the support roller (13, 28, 29) extend centrally into the channels.

3. The device according to claim 1, characterized in that the combing elements (9) have a leading edge defining a breast angle a measured with respect to a radius of the opening roller (8), the breast angle $\alpha$ being between about +5° and about −10°.

4. The device according to claim 3, characterized by a negative-pressure source for generating an air current of a negative pressure below about 10 mbar for entraining fibers separated from the opening roller (8).

5. The device according to claim 4, characterized in that the negative-pressure source generates an air current of a negative pressure of about 3 to about 5 mbar.

6. The device according to claim 1, characterized in that the circumferential speed of the opening roller (8) is less than about 15 meters per second (m/s).

7. The device according to claim 1, characterized in that the circumferential speed of the opening roller (8) is about 5 to about 10 meters per second (m/s).

8. The device according to claim 1, characterized in that the support roller (13, 28, 29) is coupled via a gear drive to the opening roller (8) and that the translation ratio between the opening roller (8) and the support roller (13, 28, 29) is about 1:2.

9. The device according to claim 1, characterized in that at least a partial area of the surface of the combing elements (9, 14, 24, 25, 26) is designed as a roughened surface.

10. The device according to claim 1, characterized in that the spiral of the combing elements (14, 25, 26) of the support roller (28, 29) is interrupted about the circumference of the roller by sections free of combing elements.

11. The device according to claim 1, characterized in that the combing elements (25, 26) of the support roller (28, 29) comprise sections of a V-shaped thread.

12. The device according to claim 1, characterized in that the support roller (13, 28, 29) is mounted in a holder (12) which carries the sliver feed device.

13. The device according to claim 1, characterized in that the opening roller (8) and the support roller (13, 28, 29) have markings (19) for indicating their relative positioning.

14. A device for opening slivers (4) for feeding an OE spinning device (3), comprising a sliver feed device defining a sliver clamping position (7), a rotating opening roller (8) having a circumference with spirally extending combing elements (9, 24) for engaging at the clamping position (7) into a sliver being fed by the sliver feed device, and a support roller (13, 28, 29) rotating in the opposite direction from the opening roller (8) and comprising spirally extending combing elements (14, 24, 25, 26), the respective combing elements of the opening roller (8) and the support roller (13,28,29) meshing with one another in a common effective range (11) adjacent the clamping position (7) downstream of the direction of sliver feeding by the sliver feed device, the combing elements of the support roller (13, 28, 29) extending into intermediate spaces between the spirals of the combing elements (9, 24) of the opening roller (8).

* * * * *